United States Patent [19]

Havey, Jr. et al.

[11] Patent Number: 4,619,101

[45] Date of Patent: Oct. 28, 1986

[54] SHEET FOLDING INSERTING MACHINE

[75] Inventors: Edward J. Havey, Jr., Stamford; Carl Miller, Fairfield; Ted Westerman, Easton, all of Conn.

[73] Assignee: Pitney Bowes Inc., Del.

[21] Appl. No.: 808,964

[22] Filed: Dec. 16, 1985

[51] Int. Cl.[4] ..... B65B 63/04

[52] U.S. Cl. ..... 53/117; 53/266 A; 493/421

[58] Field of Search ..... 53/117, 429, 266 A, 53/390; 493/421, 420, 419, 249

[56] References Cited

U.S. PATENT DOCUMENTS

| | | | |
|---|---|---|---|
| 2,019,212 | 10/1935 | Clare | 53/117 |
| 2,728,178 | 12/1955 | Kern | 53/117 X |
| 2,865,155 | 12/1958 | Nydegger | 53/117 |
| 2,912,807 | 11/1959 | Kummer | 53/117 |
| 2,915,863 | 12/1959 | Kummer | 53/117 |
| 3,797,196 | 3/1974 | Harbison | 53/117 X |

*Primary Examiner*—James F. Coan

*Attorney, Agent, or Firm*—Martin D. Wittstein; Albert W. Scribner; William D. Soltow, Jr.

[57] ABSTRACT

A simplified sheet folding and envelope inserting machine is disclosed for folding and inserting of the folded sheets into envelopes. The machine is designed so that immediate access is gained when the top half is pivoted open. When opened, the first buckle chute is automatically opened, and access to another buckle chute is achieved by pivotally raising the upper wall of the other buckle chute. Jam access to the envelope filling station is immediate, since the sheet inlet guide is positioned over the inserting station, and the inlet guide raises with the top half of the machine.

6 Claims, 17 Drawing Figures

SHEET FOLDING INSERTING MACHINE

FIELD OF THE INVENTION

1. Background of the Invention

The present invention is directed to a small, compact folding and inserting machine for folding sheets in a predetermined manner and for inserting the folded sheets into an envelope. There is references available which describe the construction of, manufacture of, and applicability of folding machines which are additionally utilized as an inserting machine. While these references representing the prior art combine folding and inserting there is no provision which allows for or describes a suitable way to avoid removing certain major components of the machine to assist in jam clearance. For example, it is especially important to gain access to the buckle chute sheet guiding assemblies where portions of the sheets are temporarily confined during the folding procession in these machines.

It is becoming increasingly important to provide such jam clearance to the sheet paths and buckle chutes of folding and inserting machines since there is an increasing requirement in the field to fold more than one sheet at a time. Depending upon humidity, caliper of the sheets, including the condition of the sheets, jams are more often likely to occur than not, and occurrence of jams increase with the multi-sheet folding requirements. It is also a major consideration that safety of the machine operator is paramount, and typically presently known folding and inserting machines have numerous, projecting components like buckle chutes which can present a hazard to the operator who is casually working near or around such machines.

Typically, the prior art, including the references cited in the present disclosure illustrate the use of folding rollers, and removable buckle chute assemblies. It will be evident that the references do not illustrate a folding-inserting machine which is compactly arranged within covers, since it is advantageous with the machines represented by the prior art to gain access to the jam prone areas of the folding machine, including the buckle chutes by removing the buckle chutes completely from the machine. The present invention has provided a compact, covered inserting and folding machine which is safely placed in the office, and which further substantially reduces noise emission caused by sheet folding.

Therefore, with the foregoing in mind, a brief description of the prior art is now provided.

2. The Prior Art

U.S. Pat. No. 3,193,983 disclosed a desk or table model folder-inserter machine.

U.S. Pat. No. 3,495,818 discloses a sheet folding apparatus which has a compact buckle chute wherein the setting of each buckle chute can be adjusted without removing it from the machine.

U.S. Pat. No. 3,510,122 discloses a folding machine within which all of the working components for storing, feeding, folding and discharging sheets of paper are located on one side of an interface of the machine to permit joining to other paper handling machines.

U.S. Pat. No. 3,516,655 discloses a method and means for fold adjustment in a buckle chute folding machine. The invention is concerned with improved means for facilitating the setting of the buckle chute stops to obtain desired fold lengths.

SUMMARY OF THE INVENTION

The present invention relates to a simplified sheet folding and envelope inserting machine for folding sheets of paper, and for inserting the folded sheets into envelopes. The machine provides operator access to the sheet folding and inserting components to facilitate jam clearance. The folding and inserting machine is composed of a housing having a lower section defining a base and an upper section defining a cover. The cover is pivotably connected to the base so that the cover can be raised and lowered relative to the base. There is a sheet entry guide in the cover which defines an entrance slot for feeding sheets into the folding and inserting machine, and there is sheet exit guide located in the base which defines an exit slot for folded sheets. The sheets are conveyed through the machine by a plurality of folding rollers, which are mounted in the housing for receiving sheets from the entrance slot and for delivering folded sheets to the exit slot. There is a pair of buckle chutes in the housing which are located adjacent to the folding rollers for receiving a portion of sheets from the rollers to cause the rollers to form folds in the portion of the sheets not received within the buckle chutes. One of the buckle chutes of the pair of buckle chutes is located in the cover and the other buckle chute is located in the base. The one buckle chute is defined by an upper wall fixedly mounted in the cover and a lower wall which is located in spaced, parallel juxtaposition with the upper wall. The lower wall is pivotally connected to the cover so that when the cover is raised from a closed to an open position, the upper wall separates from the lower wall to expose the inside of one buckle chute. The other buckle chute is defined by a lower wall which is in spaced, parallel juxtaposition with the lower wall. The upper wall is pivotally connected to the base so that the upper wall can be raised from a normal position to an open position to expose the inside of the other buckle chute.

The machine further includes a device mounted on the base adjacent to the exit slot, for holding an envelope in position to receive folded sheets passing through the exit slot.

OBJECTS OF THE INVENTION

Therefore, having briefly described the present invention in the foregoing summary, some of the advantages and objects of the invention will be listed. For example, it is a principal objective of the present invention to provide a simplified sheet folding and inserting machine which is suitable for use within the office, and which may further be stored in a desk drawer.

It is another object of the present invention to provide a folding and inserting machine which is compactly arranged within covers.

It is yet another object of the present invention to provide an inserting and folding machine which opens up to expose the sheet conveying portions of the machine.

It is a further object of the present invention to provide an inserting and folding machine which permits immediate clearance of a jam within the first buckle chute of the machine when the machine cover is raised to an open position.

It is a still further object of the present invention to provide an folding and inserting machine which permits access to the second buckle chute when the machine cover is raised and an upper member defining the upper surface of the second buckle chute is pivotally raised to expose the interior of the buckle chute.

It is a further object of the present invention to provide a folding and inserting machine which is safe in so far as enclosing all moving or stationary projecting parts which might otherwise be intercepted by an operators fingers or hands.

And, it is still a further object of the present invention to provide an inserting and folding machine which substantially reduces the noise projected by the folding of sheets or the like.

DESCRIPTION OF THE PREFERRED EMBODIMENT

Figure 1:
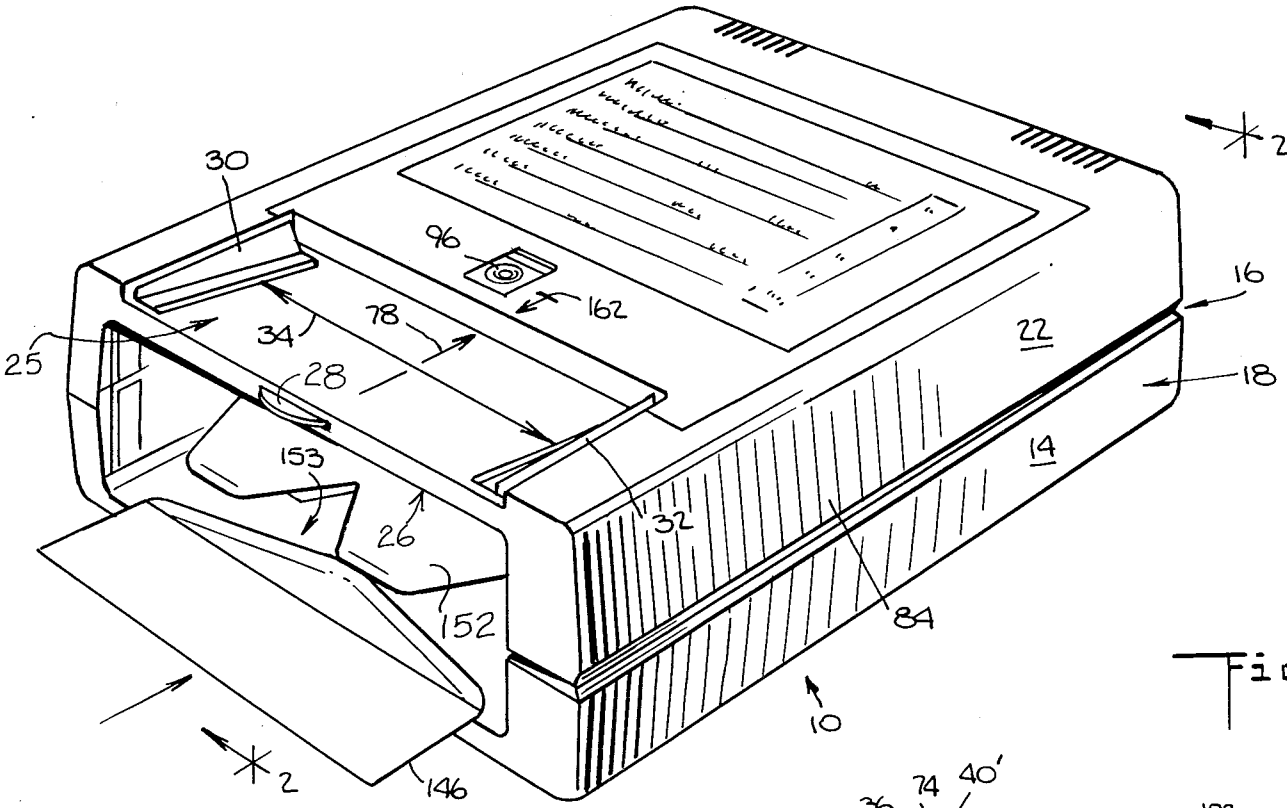
FIG. 1 is an isometric view of the folding and inserting machine of the present invention.
Figures 2, 6, 7, 8:
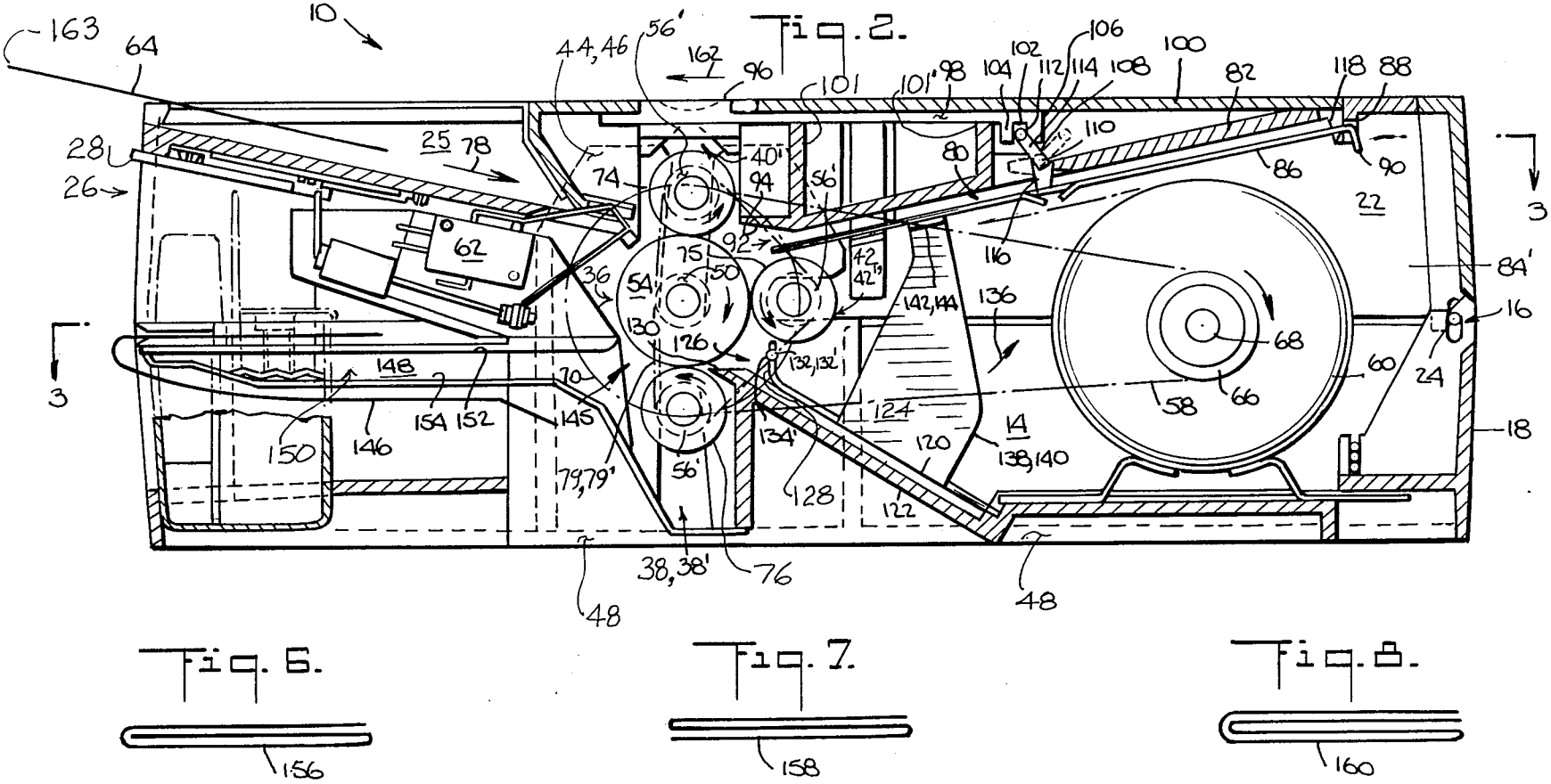
FIG. 2 is a sectional, full side view of the folding and inserting machine with the front cover removed. The view is taken along the lines of 2—2 from FIG. 1, and shows the relationship of parts attached to the upper cover to the base portion of the machine.
FIG. 6 is an end view of a $8\frac{1}{2}''\times 11''$ sheet which has been folded by the machine of the present invention into a standard fold.
FIG. 7 is an end view of a $8\frac{1}{2}''\times 11''$ sheet which has been folded by the machine of the present invention into a "Z" fold.
FIG. 8 is an end view of a $8\frac{1}{2}''\times 14''$ sheet which has been folded into a legal fold.

Referring to FIGS. 1 and 2, there is shown a sheet folding and envelope inserting machine 10. The machine 10 has a housing 14 with a lower section defining a base 18 and an upper section defining a cover 22. The machine 10 is constructed so that the upper section and cover 22 may be pivotally raised and lowered as an assembly with respect to the base 18. The cover 22 is attached to the base 18 at a pivot 24 which generally extends along an end 16 of the machine 10.

There is an entrance slot 25 located in an end 26 of the cover 22 for feeding sheets of paper into the machine 10. An adjustment knob 28 is provided to allow lateral adjustment of a pair of sheet guide brackets 30 and 32. The brackets 30 and 32 are suitably connected to the knob 28 and move in a lateral direction 34 when it is required to feed sheets of different widths into the slot 25.

Figure 3:
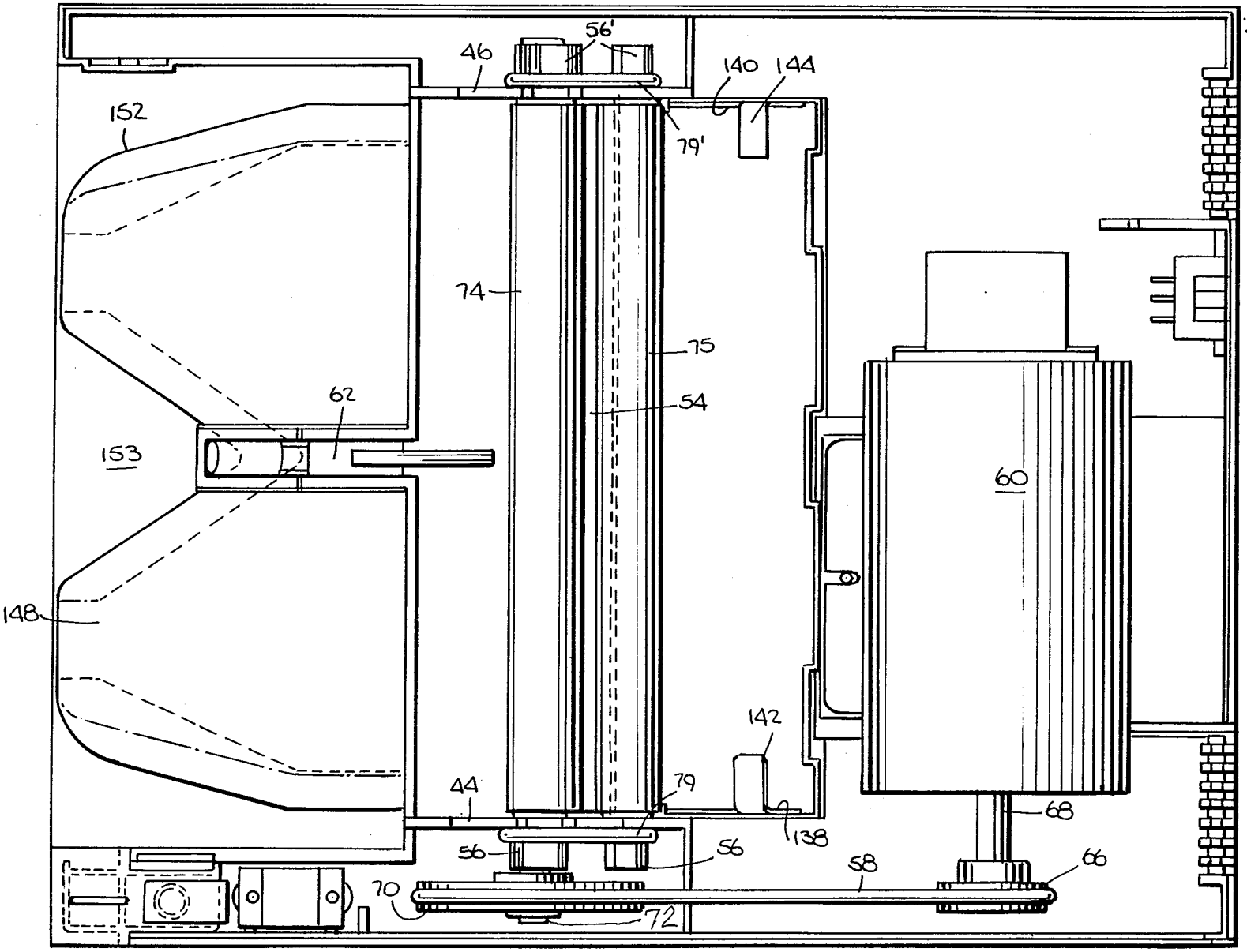
FIG. 3 is a sectional, top view taken along the lines of 3—3 from FIG. 2, to show the components located within the base.
Figure 4:
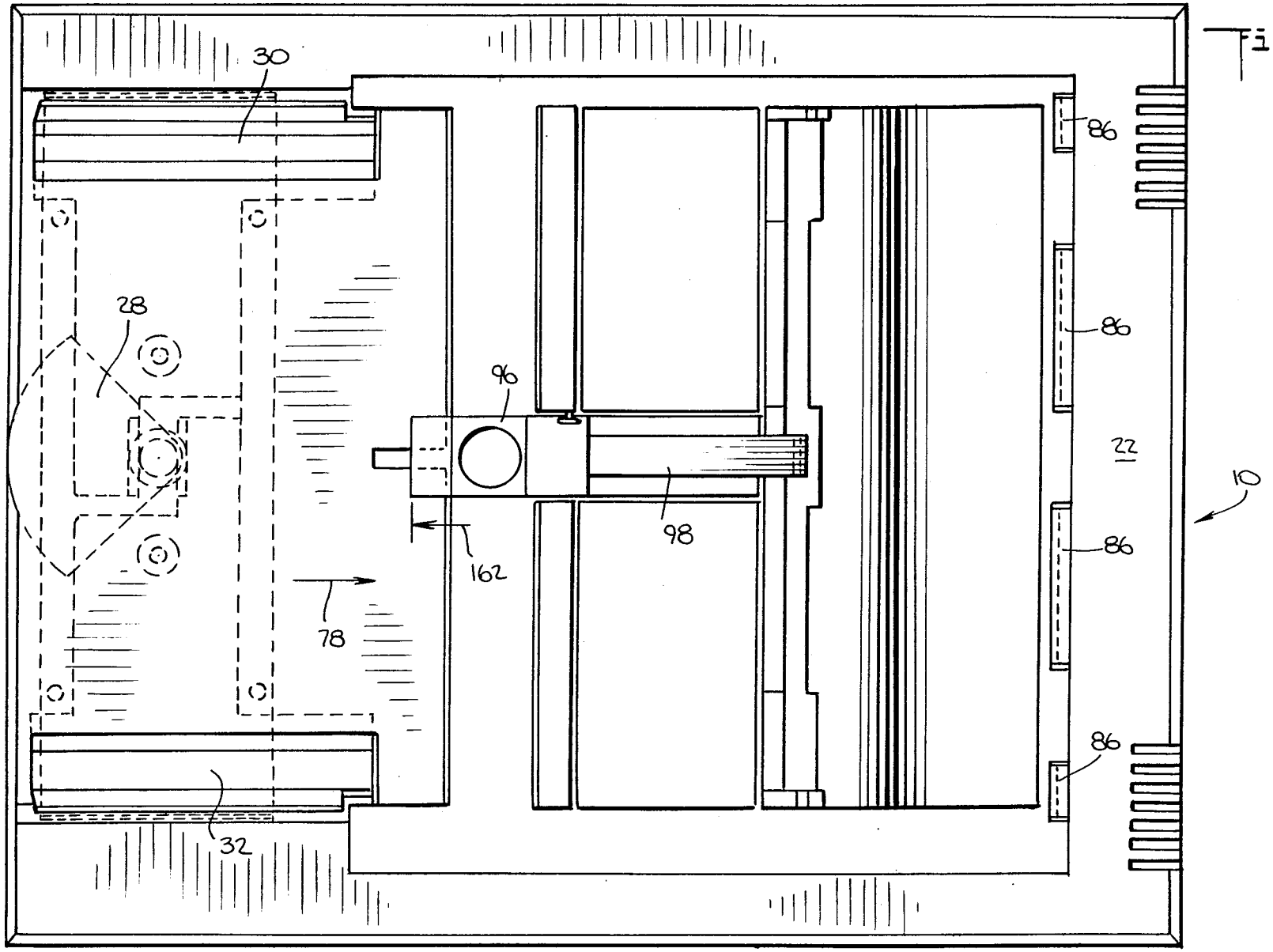
FIG. 4 is a full top view of the folding and inserting machine, with the instruction plate removed.

Referring to the side view, FIG. 2, there is shown more details of the interior portions of the machine 10. The FIG. 2 is viewed for the sake of clarity as if one were looking at the machine without a front cover. A plurality of folding rollers 36 is mounted in the housing 14 for the purpose of conveying the sheets fed into the entrance slot 25. The housing 14 is fabricated of a plastic, molded frame which has three separate slots, 38, 40 and 42 and 38', 40' and 42' respectively formed in a spaced apart pair of upstanding walls 44 and 46. The walls 44 and 46 are joined to a floor section 48 of the housing 14. The plurality of folding rollers 36 includes a main roller 54 which is rotatably supported by a bearing 50 located in each slot 40 and 40', in the respective walls 44 and 46. The main roller 54 is rotatably driven by a drive belt 58. There is a 115 VAC power supply connected to a motor 60 which is switched on to operate cyclically when a switch 62 is tripped by a sheet 64 which is guided into the entrance slot 25. There is a pulley 66 suitably mechanically fastened to a shaft 68 of the motor 60, and a second pulley 70 similarly fastened to a journal 72 (see FIG. 3) of the main roller 54. When the motor 60 is turned on by the aforementioned trip switch 62, the drive belt 58 causes the main roller 54 to rotate in a clockwise direction.

Referring back to FIG. 2, there is a first, second and third pressure roller 74, 75 and 76 respectively which are resiliently loaded against the main roller 54 which all rotate when the main roller 54 rotates. There is a pair of bearings 56 and 56', (see FIG. 3) adapted to the end journals of each roller 74, 75 and 76 and to the aforementioned slots 38, 40, and 42 respectfully so that the rollers 74, 75 and 76 may suitably rotate and fold the sheets according to the requirements of the machine operator. A tension spring 79 and 79' with its ends suitably connected together is wrapped around the bearings 56 and 56' of each roller 74, 75, and 76 in order to apply sufficient pressure to the end journals of each of the rollers to provide the necessary conveying and folding requirements.

Figure 5:
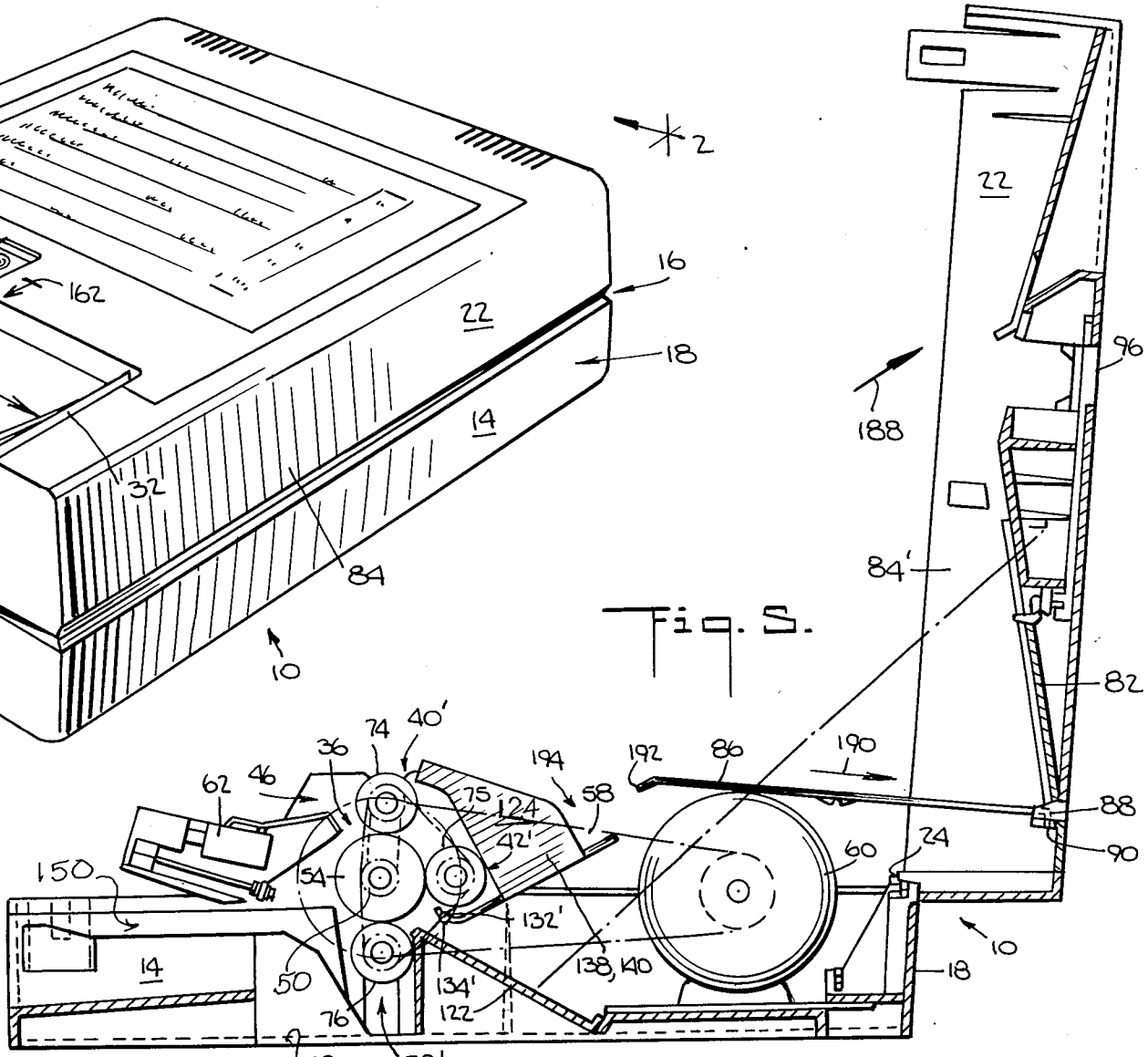
FIG. 5 is a sectional full side view of the folding and inserting machine, with the upper cover pivoted to the open, jam clearance, position.

Referring back to FIG. 2 the combination of the main roller 54, and the pressure roller 74 together cause the sheet 64 to advance along a path 78 which initially leads to a first buckle chute 80 of a pair of buckle chutes. The first buckle chute 80 is formed within the cover 22 between an angled wall 82 which is molded integrally with the cover 22 and is inclined downwards slightly, and which laterally spans between end wall 84 (see FIG. 1) and and a rear end wall 84' of the cover 22. There is a lower wall member 86 which forms the major part of a lower portion of the first buckle chute 80. Best seen in FIG. 2, the lower wall member 86 is pivotally connected to the cover 22 at an abutment wall 88 which is molded integrally with the cover 22. There is an angled tab 90 which restrains the lower wall member 86 from disconnecting from the abutment 88 while permitting pivoting of the wall 82 when the cover 22 is raised, as best seen in FIG. 5.

Referring back to FIG. 2 there is an entrance slot 92 to the first buckle chute 80 for receiving the leading end of the sheets after they leave the nip of the rollers 54 and 74. The slot 92 is formed by an angled surface 94 of the wall 82 which serves to guide the sheets into the spaced, parallel opening comprising the first buckle chute 80 as located between the wall 82 and the juxtaposed lower wall member 86.

Referring to FIG. 1, there is shown a selecting knob 96 for providing three alternate fold configurations ranging between a 8½"×11" or a 8½"×14" legal sized sheet. The selecting knob for handling 96 is integrally formed with a member 98 and is disposed in a horizontal direction. Referring back to FIG. 2, the knob 96 and interconnecting member 98 is slidably secured to the cover 22 between a horizontal wall 100 which serves as an instruction plate, part of the cover 22 and an upright wall 101 and 101' which are joined to the wall 82. There is a vertical slot 102 formed between two downwardly reaching lugs 104 and 106 which are molded and joined to the member 98. A member 108 is pivotally mounted at a center 110 which is suitably connected to the wall 82. A round lug 112 formed on an arm 114 of the member 108 is connectively engaged with the vertical slot 102 of the member 98 so that operator imposed, horizontal movement of the knob 96 causes the member 108 to rotate into a projecting position in the path 78 where an abutment arm 116 connected to the member 108, will intercept and abruptly stop the travel of the leading end of the sheet 64. Alternately, the knob 96 may be moved to allow the sheets to continue to an abutment located downstream within the chute 80. The intercept or alternate pass function of the member 108 relates to the selection of the type of fold as determined by the operator through position of the knob 96 and which will be described later in the present specification under the operational description of the invention.

There is an abutment 118 formed from the abutment wall 88 at the pivot end 16 of the machine 10 within the cover 22. The abutment 118 is located to stop the sheets as far as possible, downstream within the first buckle chute 80.

Another buckle chute 120 is located within the base 18 such that a lower wall 122 forms the lower half of the buckle chute 120. The wall 122 is appropriately joined at each lateral end to the upstanding lateral walls 44, and 46, 84 and 86. There is a pivotable upper wall member 124 which is located in spaced parallel juxtaposition with the respect to the lower wall member 122. The other buckle chute 120 is adapted to receive the sheets being conveyed and folded at the nip of the main roller 54 and 75. There is an entrance throat 126 which is located downstream and adjacent to the rollers 54 and 75, and which is defined by a flared portion 128 of the member 124, and a beveled end 130 of the wall 122.

The flared portion 128 of the upper wall member 124 has a suitable tab 132 and 132' located at the front and rear lateral end, adjacent to the respective wall members 44 and 46. Each tab fits into a hole 134, and 134 each of which is located in the respective upstanding walls 44 and 46 so that the member 124 may be pivoted in a counterclockwise direction 136 to expose the inside of the buckle chute 120, and if necessary, to allow clearance of any sheet jam therein.

The upper wall member 124 has formed upstanding spacer members comprising upstanding arms 138 and 140, which are laterally located adjacent to an inside surface of the upstanding walls 44 and 46. There is a pair of bent tabs 142 and 144 formed from the arms 138 and 140 respectively which normally supports the lower wall member 86 of the first buckle chute 80 when the cover 22 is in the lowered position shown in FIG. 2.

The nip between the main roller 54, and the roller 76 causes the last fold on each sheet while simultaneously causing the folded sheet to exit through an exit slot 145 into a waiting envelope 146. There is an envelope horn 148, located downstream of the rollers 54 and 76. The horn 148 is comprised of a plate member 152 which is rigidly mounted in a substantially horizontal position with respect to the base 18 such that a folded sheet, or as the case may be, folded sheets are ejected into a pocket 150 which is formed between the plate member 152, and a spring plate 154. The spring plate 154 is appropriately attached to the floor 48 of the base 18, so that it may yield when necessary.

At the convenience of the machine operator, the envelope 146 is then removed from the envelope horn 148 with the folded sheet enclosed. This is accomplished when the operator grasps the envelope, and simply pulls the envelope with contents to the left, away from the horn 148. There is a relief 153 (see FIG. 1) in the plate member 152 (FIG. 3) which permits the operator to effectively pinch the envelope 146 with its enclosed, folded sheet, and thereby remove it from the machine.

Description of the Operation of the Machine

It is required that the operator of the machine 10 know the size of the sheet to be processed. Typically, standard letter sheets are 8½"×11" and legal size, 8½"×14", or are in the associated metric sizes. The machine 10 has provisions to make three different folds. Referring to FIG. 6, there is illustrated a standard fold 156. In FIG. 7 there is illustrated a "Z" fold 158 and in FIG. 8 a legal fold 160. The standard fold 156 and "Z" fold 158 are satisfactory for 8½"×11" sheets while the legal fold 160 accommodates the 8½"×14" size sheets.

Folding of 8½"×11" Sheets to a Standard Fold

Figure 9:
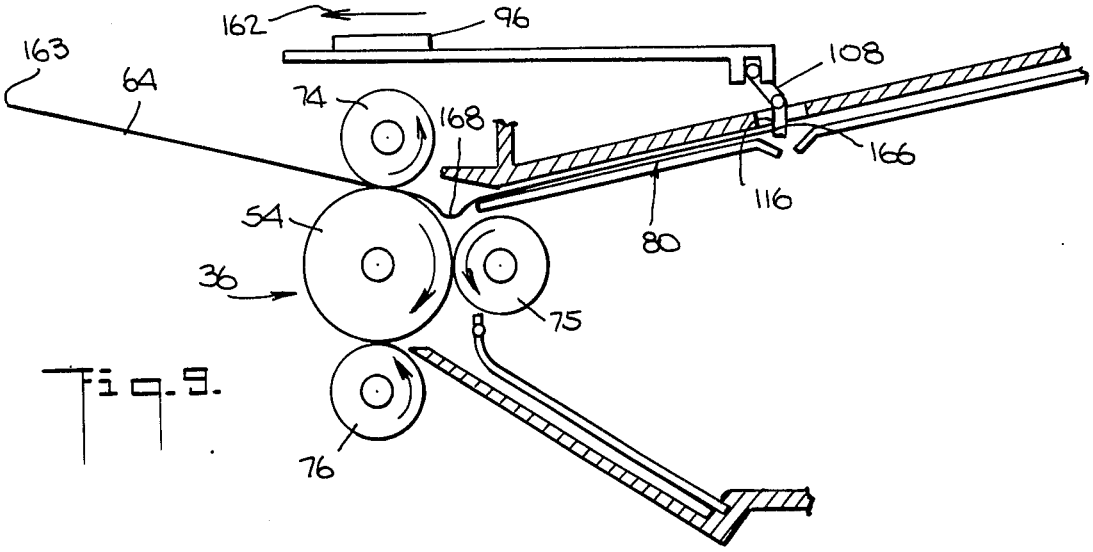
FIG. 9 is a schematic end view taken along the same direction as FIG. 2, showing the essential folding rollers, and first buckle chute adapted for producing a standard fold of a $8\frac{1}{2}''\times 11''$ sheet.

The selecting knob 96 should be left in a position 162 which is shown in FIG. 1, and which positions the knob 96 closest and adjacent to the entrance slot 25. The operation of machine 10 is started when the sheet 64 is positioned within the entrance slot 25 such that the 8½" dimension will fit between the lateral sheet guide bracket 30 and 32. The sheet 64 subsequently trips the switch 62 while being manually pushed along the path 78 by the machine operator. The sheet 64 is then accepted into the nip defined between the main roller 54 and the pressure roller 74 as seen in FIG. 9.

When the switch 62 is enabled by the sheet 64, the motor 60 starts, and the main roller 54 immediately begins rotating in a clockwise direction through the drive components described in the preceding text. The motor 60 continues to cause rotation of the main roller 54, throughout the processing of the sheet 64 until a trailing end 163 (see FIG. 2) of the sheet 64 passes by the switch 62. After a predetermined delay the motor 60 is then automatically shut off.

Figure 10:
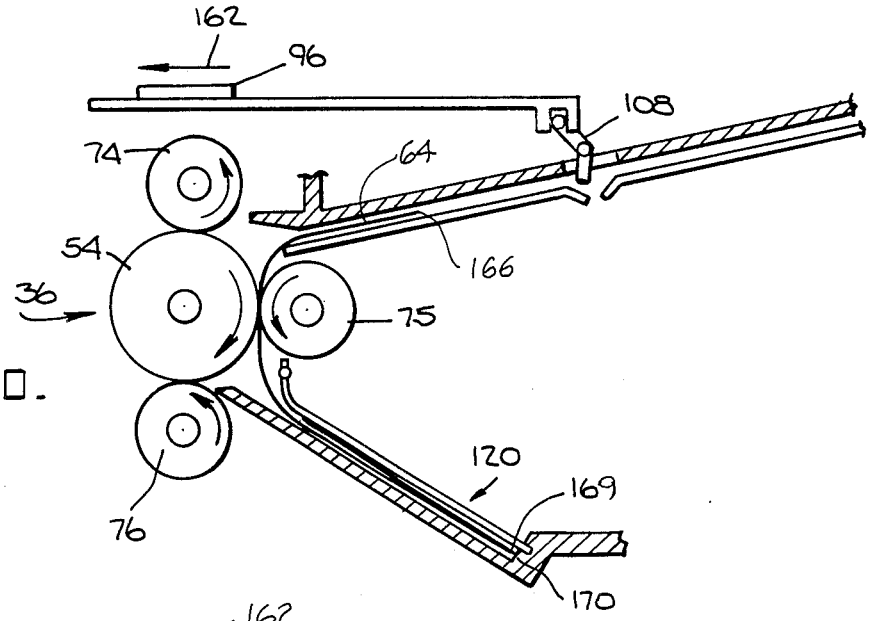
FIG. 10 is a schematic end view taken along the same lines of FIG. 9, showing the $8\frac{1}{2}''\times 11''$ sheet with the first fold having been made.

Referring again to FIG. 1 and FIG. 9, the selecting knob 96 is left in the position 162 thereby maintaining the member 108 in a position where the abutment 116 intercepts a leading end 166 of the sheet 64 to cause the leading end 166 to stop. The sheet 64 begins to form a buckle 168 which enters the nip between the main roller 54 and the roller 75. In FIG. 10, the buckle 168 is folded over and is shown having entered the other buckle chute 120. Within the buckle chute 120, a folded end 169 of the sheet 64 is restrained from further movement by an abutment 170.

Figure 11:
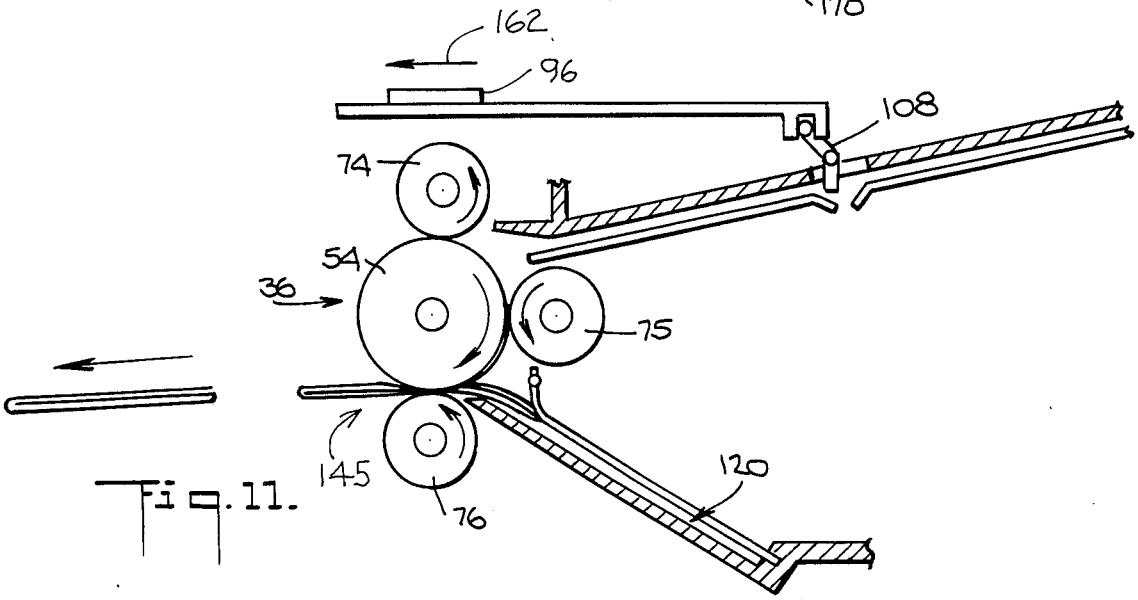
FIG. 11 is a schematic end view taken along the same lines of FIG. 9 and FIG. 10, with the $8\frac{1}{2}''\times 11''$ sheet being folded a second time and delivered in the standard fold form.

Referring to FIG. 11, it is seen that the sheet 64 buckles again and enters the nip between the main roller 54 and the roller 76 so that a standard form folded sheet is directly ejected through the exit slot 145 and is inserted into the waiting envelope 146 (see FIG. 2). In either event the folded sheet enters the pocket 150, having passed through the exit slot 145.

Folding of $8\frac{1}{2}''\times 11''$ Sheet to a "Z" Fold

Figure 12:
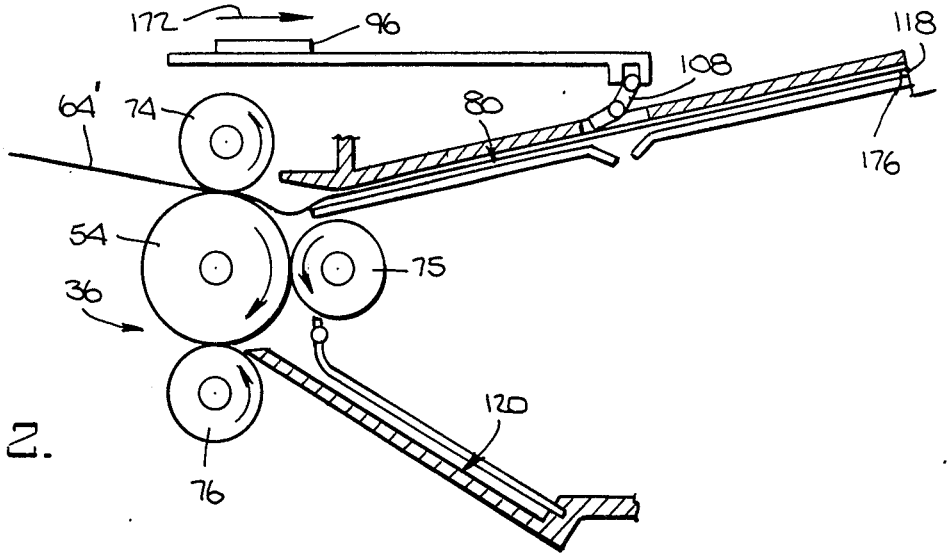
FIG. 12 is a schematic end view taken along the same lines of FIG. 9, showing the machine adapted to provide a "Z" fold to a $8\frac{1}{2}''\times 11''$ sheet.
Figure 13:
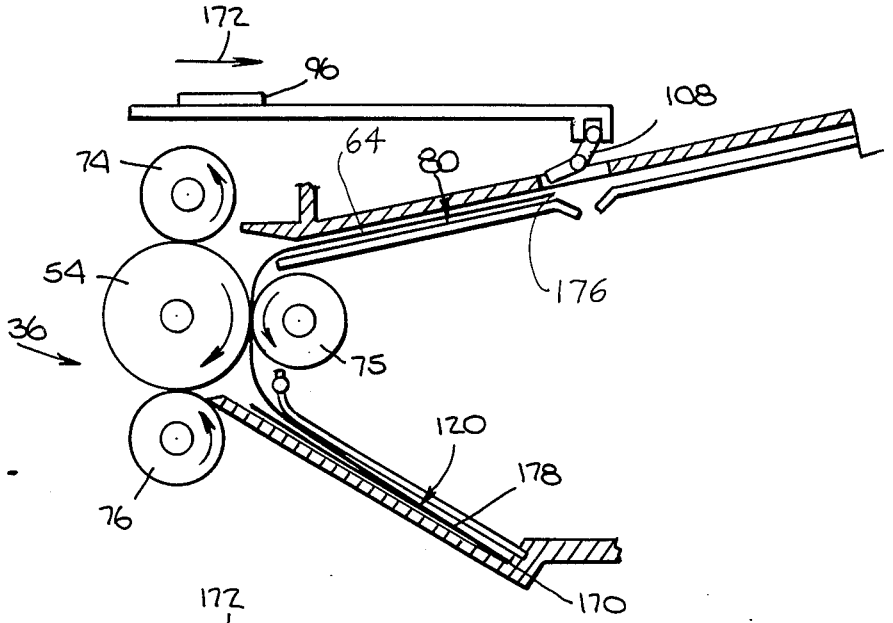
FIG. 13 is a schematic end view taken along the same lines of FIG. 12, with the $8\frac{1}{2}''\times 11''$ sheet progressing in the "Z" folding process.
Figure 14:
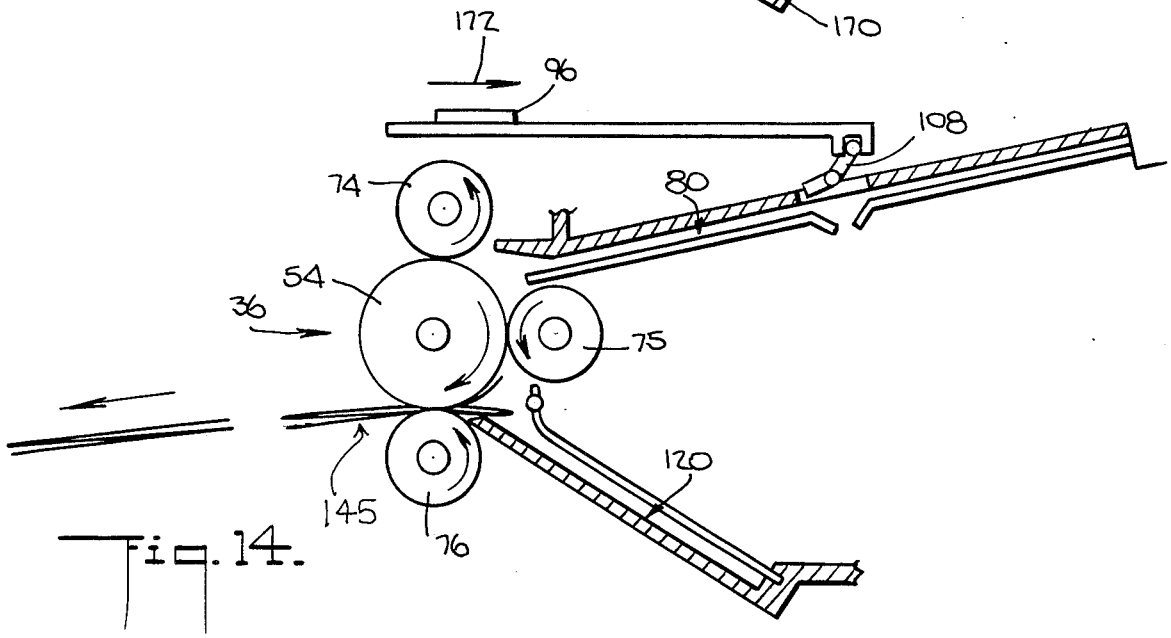
FIG. 14 is a schematic end view taken along the same lines of FIG. 12, with the $8\frac{1}{2}''\times 11''$ sheet being folded a second time, and delivered in the "Z" fold.

Referring to FIG. 12, the selecting knob 96 is shown in a legal fold position 172. Accordingly, the member 108 is operatively removed from the buckle chute 80 where it normally acts as an abutment when the knob 96 is shifted to the legal fold position 172. Then, in the course of travel of the sheet 64, a leading end 176 of the sheet 64 is shown stopped at the abutment 118 located within the buckle chute 80. The $8\frac{1}{2}''\times 11''$ sheet is shown having formed a fold 178 when the sheet 64 has passed through the nip between the main roller 54, and the roller 75. The resulting fold 178 is then located within the buckle chute 120 and is stopped against the abutment 170 in the other buckle chute 120. Referring to FIG. 14, the main roller 54 and roller 76 are shown further transporting the sheet through the nip defined therebetween, thereby providing a "Z" type folded $8\frac{1}{2}''\times 11''$ sheet which is delivered into the pocket 150 (see FIG. 2).

Folding of $8\frac{1}{2}''\times 14''$ Sheet to a Legal Fold

Figure 15:
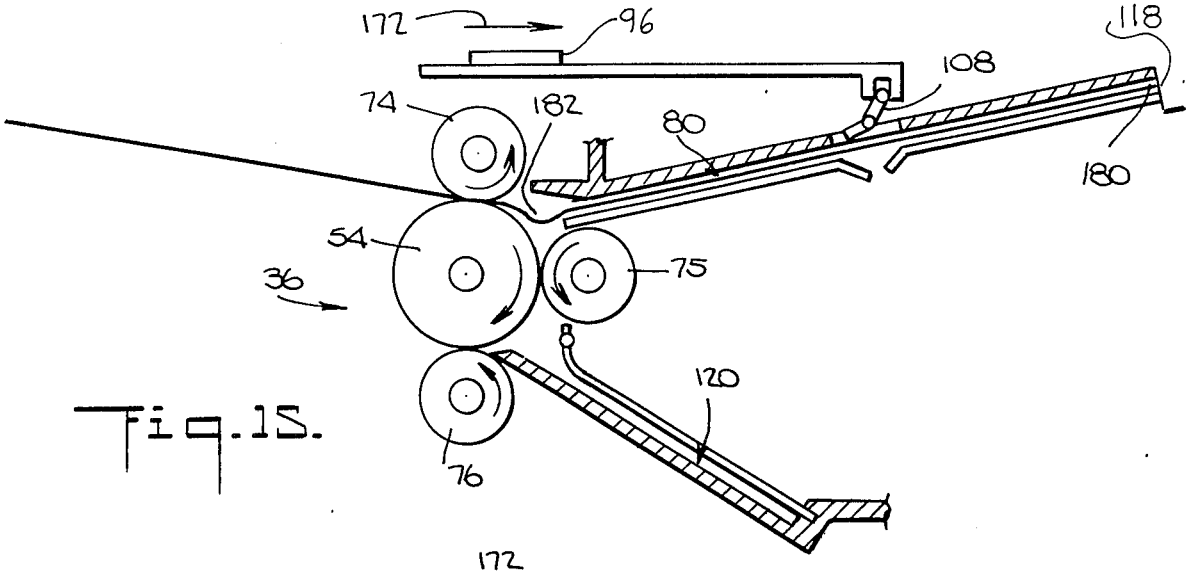
FIG. 15 is a schematic end view taken along the same lines of FIG. 9, showing the machine adapted to provide a legal type fold to a $8\frac{1}{2}''\times 14''$ sheet.
Figure 16:
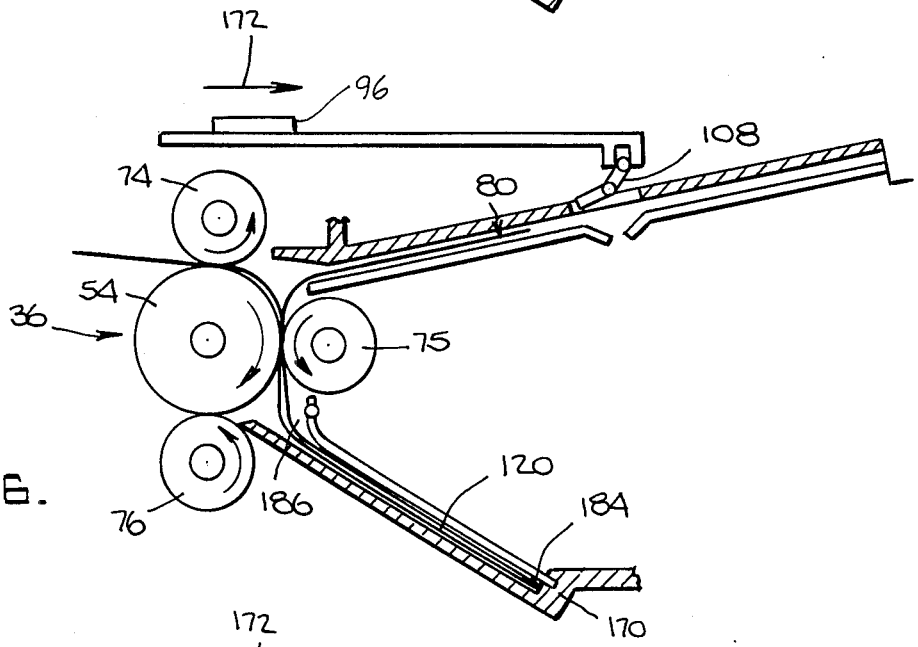
FIG. 16 is a schematic view taken along the same lines as FIG. 15, with the $8\frac{1}{2}''\times 14''$ sheet progressing in the legal size folding process.
Figure 17:
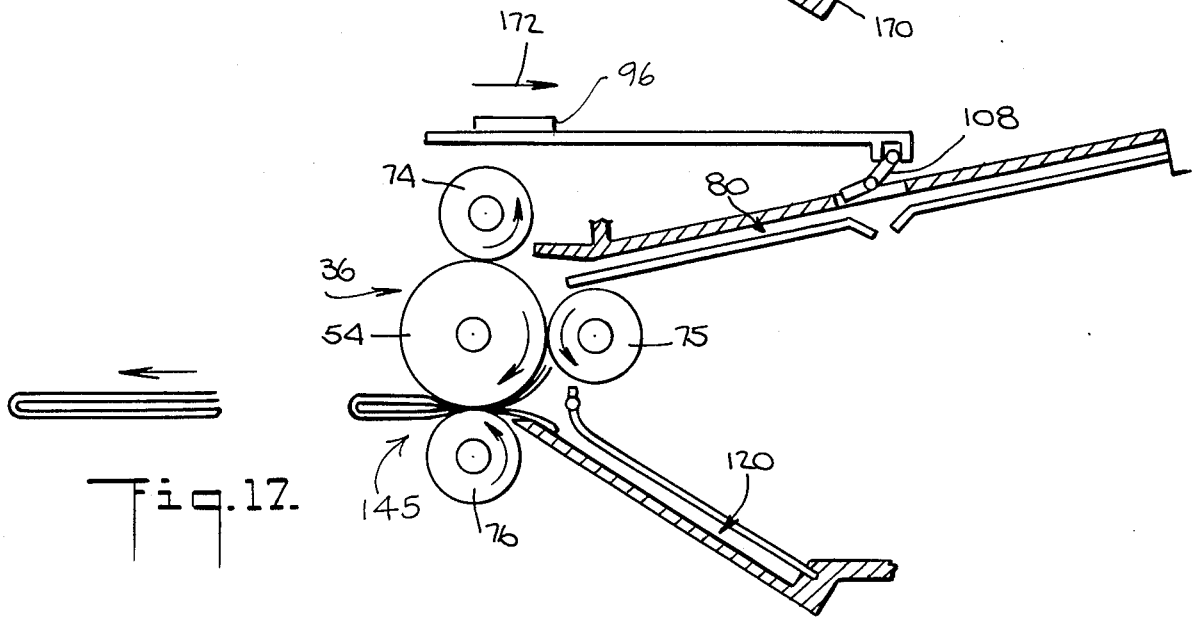
FIG. 17 is a schematic view taken along the same lines as FIG. 7, with the $8\frac{1}{2}''\times 14''$ sheet delivered in a legal fold.

Referring to FIG. 15, a $8\frac{1}{2}''\times 14''$ size sheet 64 is shown moving through the rollers 36 such that a leading end 180 of the sheet 64' is stopped at the abutment 118. Again, the selecting knob 96 is located in the legal fold position 172, so that the connecting member 108 permits the leading end 180 of the sheet 64 to pass by and stop against the abutment 118 within the buckle chute 80. A fold 182 is shown forming in the sheet adjacent to the nip of the main roller 54 and the roller 75. In FIG. 16, the sheet 64' is shown with a folded leading end 184 which has stopped against the abutment 170 in the chute 120, while a buckle 186 is shown forming adjacent to the main roller 54 and the pressure roller 76. In FIG. 17, the main roller 54 and the pressure roller 76 is shown conveying the sheet there through the nip defined therebetween, so that a resulting legal size fold (see FIG. 8 and FIG. 2) is given.

It is pointed out that the folding and inserting machine 10 is capable of folding more than one sheet at a time. That is, a stack of sheets of up to and including 5 sheets may be folded simultaneously in the machine 10, as taught by the present invention and the apparatus as assembled and described.

Referring to FIG. 5, the cover 22 is shown having been raised to an opened position 188. When the cover 22 is raised, there is an appropriate safety interlock switch (not shown) which deactivates all electrical power to the machine, thereby protecting the opeator. Normally the closed machine presents a safe and virtually noiseless version of an office inserting and folding machine. The opened position 188 provides immediate jam exposure to the first buckle chute 80, and therefore an opportunity for the machine operator to clear such jam which may occur within the chute 80. Since the cover 22 is hinged at the pivot 24, the lower wall member 86 retracts in a direction 190, away from the plurality of folding rollers 36. An end 192 of the member 86 moves sufficiently far enough away from its original starting position (see FIG. 2) to provide a gap 194 which is sufficient for the operator to view deeper into the lower portions of the machine 10. The gap 194 provides further access to the operator to lift the pivotable upper wall member 124 thereby exposing the other buckle chute 120. The member 124 pivots upwards about the hole 134 and 134' as was previously described in the present specification. It is then possible to view and to reach the other buckle chute 120 to clear any possible paper jam within that chute or in any adjacent area near the chute 120.

Therefore, having described the present invention in the form of a folding and inserting machine, the benefits and objects will be more appreciated. It will be further evident that changes or modifications to the drawings or specification will not alter or distract from the nature and scope of the following appended claims.

What is claimed is:

1. A simplified sheet folding and envelope inserting machine for folding sheets of paper and inserting the folded sheets into envelopes, said machine providing operator access to the sheet folding and inserting components to facilitate jam clearance, said folding and inserting machine comprising:

A. a housing having a lower section defining a base and an upper section defining a cover, said cover being pivotally connected to said base so that said cover can be raised and lowered relative to said base, B. means in said cover defining an entrance slot for feeding sheets into said folding and inserting machine and means located on said base defining an exit slot for folded sheets, C. a plurality of folding rollers mounted in said housing for receiving sheets from said entrance slot and for delivering folded sheets to said exit slot, D. a pair of buckle chutes in said housing located adjacent said folding rollers for receiving a portion of sheets from said rollers to cause said rollers to form folds in the portion of said sheets not received within said buckle chutes, one of said buckle chutes being located in said cover and the other of said buckle chutes being located in said base, D (1) said one buckle chute being defined by an upper wall fixedly mounted in said cover and a lower wall in spaced parallel juxtaposition with said upper wall, said lower wall being pivotally connected to said cover whereby when said cover is raised from a closed to an open position, said upper wall separates from said lower wall to expose the inside of said one buckle chute, D (2) said other buckle chute being defined by a lower wall fixedly mounted in said base and upper wall in spaced parallel juxtaposition with said lower wall, said upper wall being pivotally connected to said base whereby said upper wall can be raised from a normal position to an open position to expose the inside of said other buckle chute.

2. A machine as set forth in claim 1 wherein said upper wall of said other buckle chute includes an upstanding spacer member mounted thereon, and wherein said lower wall of said one buckle chute normally overlies said upper wall of said other buckle chute and said spacer member and normally rests upon said spacer member when said cover is in a closed position.

3. A machine as set forth in claim 2 wherein said lower wall of said one buckle chute is pivotally connected to said cover at a location spaced from the pivotal connection between said cover and said base whereby when said cover is raised to an open position said lower wall of said one buckle chute is moved toward said pivotal connection between said cover and said base so as not to overlie said spacer member.

4. A folding machine as set forth in claim 3 wherein said spacer is pivotally connected to said base whereby said upper wall of said other buckle chute can be raised to an open position to expose the interior of said other buckle chute after said cover has been raised to its open position.

5. A machine as set forth in claim 1 further including means mounted on said base, adjacent said exit slot for holding an envelope in position to receive folded sheets passing through said exit slot for holding an envelope in position to receive folded sheets passing through said exit slot.

6. A machine as set forth in claim 5 wherein said means defining said entrance slot also includes a sheet supporting deck on which sheets are guided toward said entrance slot, said sheet supporting deck normally overlying said envelope holding means and moving upwardly with said cover when said cover is raised to its open position thereby exposing said envelope holding means.

* * * * *